US007018169B2

(12) United States Patent
Phillip et al.

(10) Patent No.: US 7,018,169 B2
(45) Date of Patent: Mar. 28, 2006

(54) FLUID FLOW CONTROL APPARATUS

(75) Inventors: Andrew G. Phillip, Champaign, IL (US); Brian Aiken, Middletown, CT (US); H. Ross Edmunds, Roanoke, VA (US); Brian E. Lindholm, Salem, VA (US); Christopher McMenamin, Salem, VA (US); Pedro Monclova, Salem, VA (US); Christopher T. Moore, Troutville, VA (US)

(73) Assignee: General Electric Company, Schenectady, NY (US)

( * ) Notice: Subject to any disclaimer, the term of this patent is extended or adjusted under 35 U.S.C. 154(b) by 82 days.

(21) Appl. No.: 10/708,286

(22) Filed: Feb. 23, 2004

(65) Prior Publication Data

US 2005/0186066 A1 Aug. 25, 2005

(51) Int. Cl.
*F04D 29/54* (2006.01)

(52) U.S. Cl. ..... 415/60; 415/126; 415/146; 415/211.2; 415/221

(58) Field of Classification Search ..... None
See application file for complete search history.

(56) References Cited

U.S. PATENT DOCUMENTS

| | | | | |
|---|---|---|---|---|
| 4,648,007 | A * | 3/1987 | Garner | 361/695 |
| 5,210,680 | A | 5/1993 | Scheibler | 361/384 |
| 5,546,272 | A | 8/1996 | Moss et al. | 361/687 |
| 5,572,403 | A | 11/1996 | Mills | 361/695 |
| 5,787,971 | A | 8/1998 | Dodson | 165/121 |
| 5,793,610 | A | 8/1998 | Schmitt et al. | 361/695 |
| 5,890,959 | A | 4/1999 | Pettit et al. | 454/184 |
| 6,000,623 | A * | 12/1999 | Blatti et al. | 236/49.3 |
| 6,031,717 | A * | 2/2000 | Baddour et al. | 361/687 |
| 6,135,875 | A * | 10/2000 | French | 454/184 |

* cited by examiner

*Primary Examiner*—Ninh H. Nguyen
(74) *Attorney, Agent, or Firm*—Cantor Colburn LLP

(57) ABSTRACT

A device for controlling a fluid flow is disclosed. The device includes at least two fluid flow drivers, a plenum disposed to receive a fluid flow from the at least two drivers, and a baffle disposed within the plenum. The plenum has a first cross-sectional area proximate the at least two drivers and a second cross-section area at a distance from the at least two drivers, the second cross-sectional area being an exit for the fluid flow. The baffle has a first edge restrained proximate the first cross-sectional area and a second opposing edge freely disposed proximate the second cross-sectional area. The baffle has a surface area responsive to the fluid flow within the plenum to reduce a backflow if one of the at least two drivers is operational and another is non-operational.

19 Claims, 3 Drawing Sheets

FLUID FLOW CONTROL APPARATUS

BACKGROUND OF INVENTION

The present disclosure relates generally to a fluid flow control apparatus, and particularly to a fluid flow control apparatus having redundant fluid flow drivers.

Some heat transfer systems may employ forced convection heat transfer techniques for removing heat from a heat generator, such as a printed circuit board or an electronic cabinet for example, where the forced convection is achieved by driving a fluid across a heat sink that is in thermal contact with the heat generator. In an exemplary heat transfer system, air may be the fluid and a fan may be the fluid flow driver. In an effort to enhance the reliability of systems employing heat generators, or where maintenance downtime of such systems is of concern, redundant fans may be employed so that one fan may continue to run if another becomes non-operational. However, in the event that one of the redundant fans becomes non-operational, backwards flow of air through the non-operational fan may result, which may reduce the effectiveness of the heat exchanger, and may produce a reverse rotation of the non-operational fan that a monitoring system may then falsely indicate as a properly operating fan. In an attempt to alleviate such false indications, back flow limiting devices have been employed that use a set of louvers to block the back flow of air through a non-operational fan. However, with such limiting devices there may still be present a degree of flow turbulence and back pressure that could reduce fluid flow rates and impact the heat transfer characteristics of the heat transfer system, and such limiting devices may require the use of a large fan for operation of the limiting device itself. Accordingly, there is a need in the art for a fluid flow control apparatus that overcomes these drawbacks.

SUMMARY OF INVENTION

Embodiments disclose herein a device for providing and controlling a fluid flow. The device includes at least two fluid flow drivers, a plenum, and a baffle. The plenum is disposed to receive a fluid flow from the at least two drivers, and the baffle is disposed within the plenum. The plenum has a first cross-sectional area proximate the at least two drivers and a second cross-section area at a distance from the at least two drivers, the second cross-sectional area being an exit for the fluid flow. The baffle has a first edge restrained proximate the first cross-sectional area and a second opposing edge freely disposed proximate the second cross-sectional area. The baffle has a surface area responsive to the fluid flow within the plenum to reduce a backflow if one of the at least two drivers is operational and another is non-operational.

Additional embodiments disclose herein a device for controlling an air flow. The device includes two fans disposed in a parallel air flow arrangement, a plenum disposed to receive an air flow from the two fans, and a baffle disposed within the plenum. The plenum has a first cross-sectional area proximate the two fans and a second cross-section area at a distance from the two fans, the second cross-sectional area being an exit for the air flow. The baffle has a first edge restrained proximate the first cross-sectional area and a second opposing edge freely disposed proximate the second cross-sectional area. The baffle flexes in response to a pressure differential across the baffle to reduce a backflow within the plenum if one of the two fans is operational and another is non-operational.

Embodiments also disclose a heat transfer apparatus having a heat exchanger and a device for providing a fluid flow. The device includes at least two fluid flow drivers, a plenum disposed to receive a fluid flow from the at least two drivers, and a baffle disposed within the plenum. The plenum has a first cross-sectional area proximate the at least two drivers and a second cross-section area at a distance from the at least two drivers, the second cross-sectional area being an exit for the fluid flow. The baffle has a first edge restrained proximate the first cross-sectional area and a second opposing edge freely disposed proximate the second cross-sectional area. The baffle has a surface area responsive to the fluid flow within the plenum to reduce a backflow if one of the at least two drivers is operational and another is non-operational. The heat exchanger is disposed proximate the exit of the device and in fluid communication with the fluid flow from the device.

BRIEF DESCRIPTION OF DRAWINGS

Referring to the exemplary drawings wherein like elements are numbered alike in the accompanying Figures.

DETAILED DESCRIPTION

Embodiments of the invention provide a redundant pair of fans for driving air across a heat exchanger via a plenum, and a baffle within the plenum for optimizing the plenum shape in the event of a non-operational fan. While embodiments described herein depict a fan as an exemplary fluid flow driver with the fluid being air, it will be appreciated that the disclosed invention is also applicable to other fluid flow drivers, such as impellers with the fluid being water, for example. Also, while embodiments described herein depict optimized air flow from a redundant pair of fans directed toward a heat exchanger, it will be appreciated that the disclosed invention is also applicable for optimizing air flow, or fluid flow generally, from a redundant pair of fluid flow drivers toward any defined direction.

Figure 1:
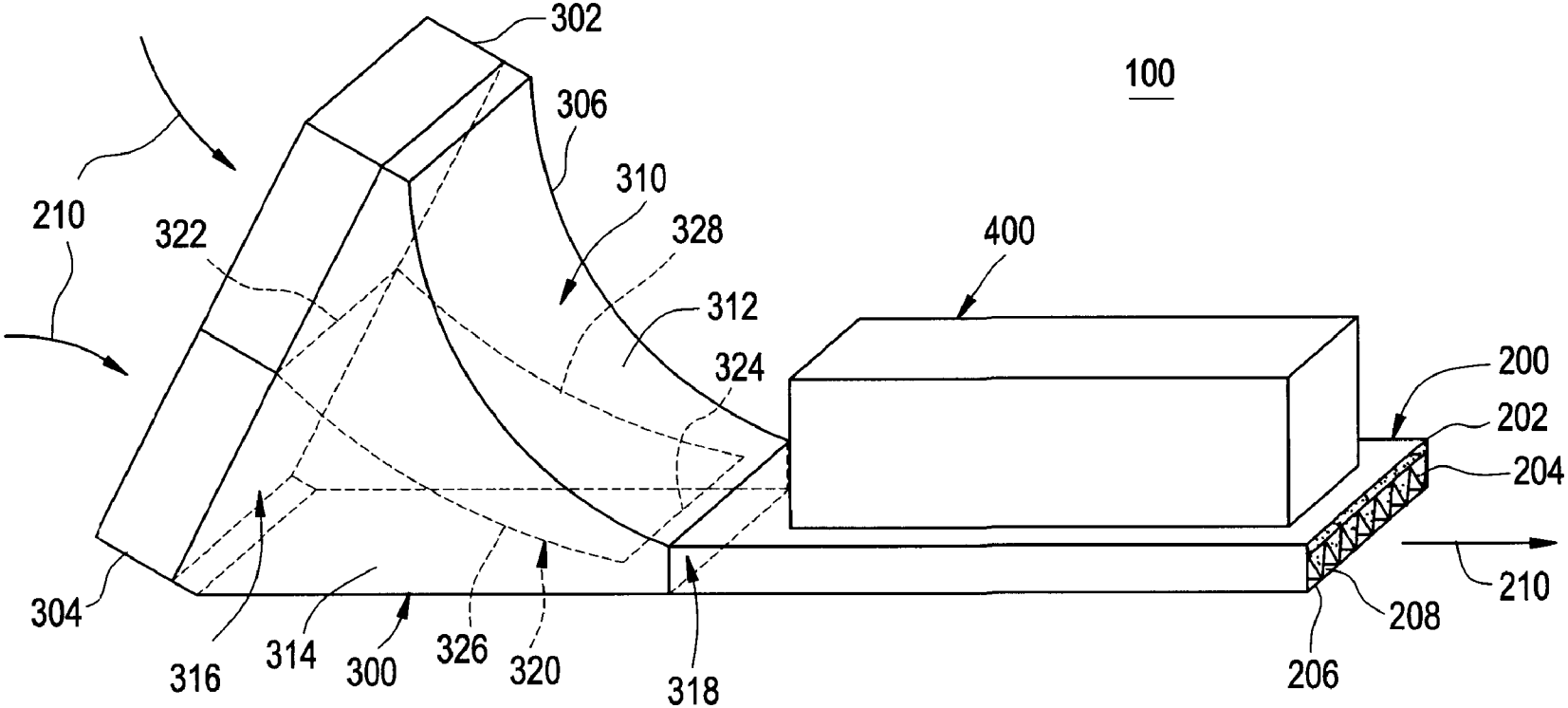
FIG. 1 depicts an isometric view of an exemplary heat transfer apparatus in accordance with embodiments of the invention.

FIG. 1 is an exemplary embodiment of a heat transfer apparatus 100 having a heat exchanger 200, a device 300 for providing and controlling a fluid flow to heat exchanger 200, and an operational unit 400 responsive to the heat transfer characteristics of heat exchanger 200.

In an embodiment, heat exchanger 200 includes a base 202 with fins 204 extending therefrom (depicted in speckled shading), and a cover 206, thereby creating channels 208 for fluid flow, such as air for example, in the direction of arrow 210. While heat exchanger 200 is depicted having triangular-shaped fins 204, it will be appreciated that fins of any shape may be used in place thereof.

In an embodiment, operational unit 400 is in thermal contact with heat exchanger 200 such that heat generated at operational unit 400 is transferred to heat exchanger 200 and then to the air flow, depicted by arrow 210, within channels 208. An exemplary operational unit 400 may include power conversion modules, electronic circuit boards with microchips, motors, transformers, or any other heat generating device that may benefit from use of a heat exchanger.

Device 300 includes two fluid flow drivers 302, 304, such as fans for example, a housing 306 defining a plenum 310 therein, and a baffle 320 within plenum 310 defining a first plenum 312 and a second plenum 314. Plenum 310 has a first cross-sectional area 316 disposed proximate the two fans 302, 304 for receiving air flow from the two fans 302, 304, and a second cross-sectional area 318 at an opposite end thereof for providing an exit (also represented as numeral 318) for air flow 210 out of plenum 310 and into heat exchanger 200. In an embodiment, fans 302, 304 are configured in a parallel fluid flow arrangement and are disposed on a common plane.

While reference is made herein to fans 302, 304 for producing an air flow 210, it will be appreciated that such structure and function may be accomplished using any type of fluid flow driver for driving any fluid suitable for carrying out the teachings of the invention.

Baffle 320 has a first edge 322 that is restrained proximate fans 302, 304 at first cross-sectional area 316, and a second opposing edge 324 that is freely disposed at the other end of plenum 310 proximate second cross-sectional area 318. First edge 322 may be pivotally or fixedly arranged at cross-sectional area 316, may be affixed proximate the center of first cross-sectional area 316 where fans 302, 304 are of the same size, or may be affixed proximate a line between fans 302, 304 where fans 302, 304 are of different sizes. Fans 302, 304 may be of the same size for redundancy, or of different sizes for employing a primary fan at a nominal flow rate and a backup fan at a lower flow rate. Second edge 324 may be freely disposed proximate the center of second cross-sectional area 318. In an embodiment, baffle 320 includes side edges 326, 328 that are also unrestrained. In an exemplary embodiment, baffle 320 is made of a flexible material, such as Lexan™ having a thickness of 0.030 inches, for example. The flexibility of baffle 320 is such that baffle 320 flexes in response to the pressure differential across the upper and lower surfaces of baffle 320, which separate first plenum 312 from second plenum 314, thereby optimizing the shapes of first and second plenums 312, 314, regardless of whether both or only one of fans 302, 304 are operational, which will be discussed later with reference to FIGS. 2–6. In an embodiment, baffle 320 is mounted in such a way as to divide plenum 310 roughly in half in response to fans 302, 304 and baffle 320 being at rest.

Figure 2:
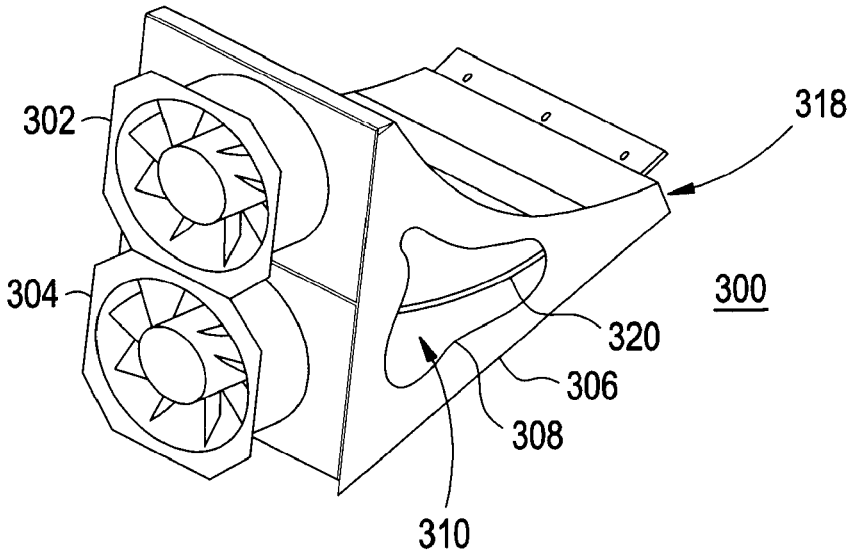
FIG. 2 depicts an isometric view of an exemplary device for providing and controlling a fluid flow in accordance with embodiments of the invention.

FIG. 2 depicts an isometric view of device 300 showing a front perspective of fans 302, 304 for driving an air flow through plenum 310, seen through a cutaway 308 of housing 306, toward heat exchanger 200 via the exit at second cross-sectional area 318.

Figure 3:
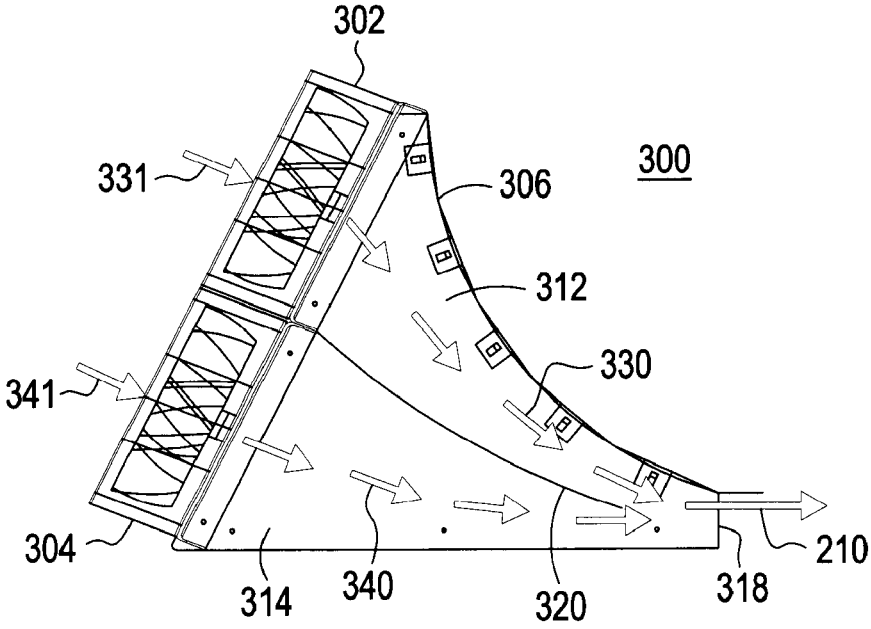
FIGS. 3–5 depict side views of the device of FIG. 2 with a side wall removed to show internal detail.

FIGS. 3–6 depict side views of the interior of housing 306 of device 300 with various airflows through plenum 310, shown as first plenum 312 and second plenum 314 separated by baffle 320. In FIGS. 3–6, a side wall of housing 306 has been removed to more clearly show the interior thereof. Referring first to FIG. 3, which depicts both fans 302, 304 being operational, baffle 320 separates a first air flow 330 from a second air flow 340 by flexing in accordance with the respective pressures caused by air flows 330, 340 on the upper and lower surfaces of baffle 320. Air flows 330, 340 combine at exit 318 to form air flow 210 directed toward heat exchanger 200. Arrows 331, 341 denote air flow being driven by operational fans 302, 304. FIG. 3 represents device 300 having two operational fans 302, 304, which provide for redundancy within apparatus 100.

Figure 4:
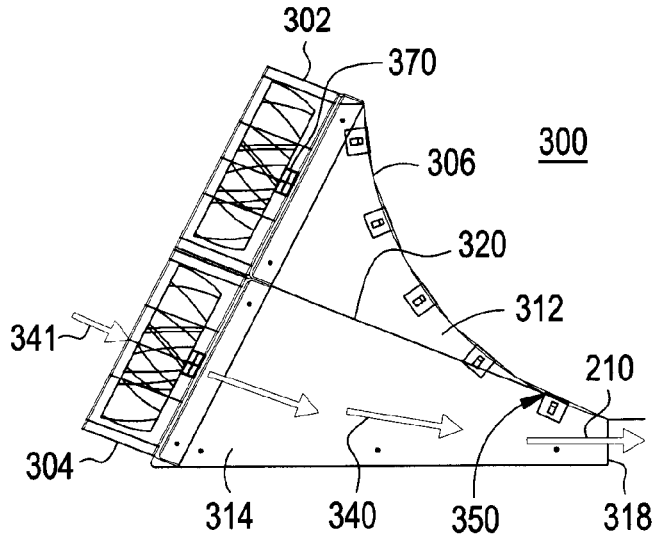
Figure 5:
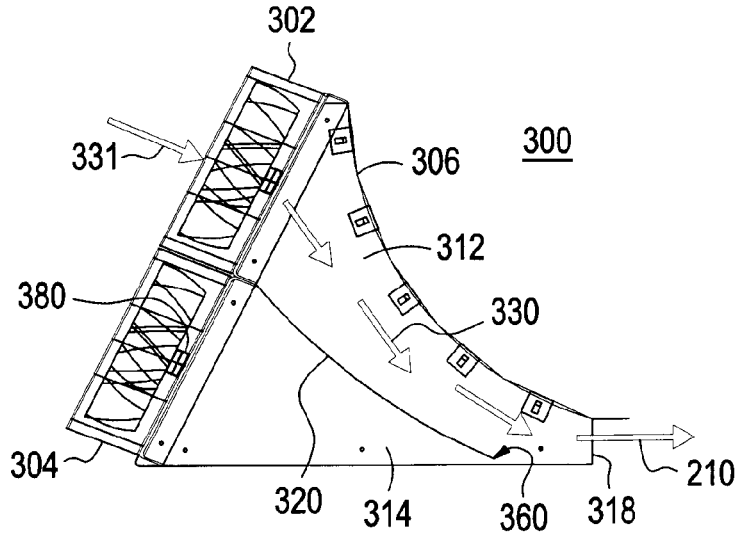

Referring now to FIGS. 4 and 5, device 300 is depicted having only one of the two fans 302, 304 being operational. In FIG. 4, fan 304 is operational, denoted by air flow arrows 341 and 340, and in FIG. 5, fan 302 is operational, denoted by air flow arrows 331 and 330. In FIGS. 4 and 5, the non-operational fan may be a fan that has been turned off for maintenance, or one that has ceased to function for any reason.

In FIG. 4, the air pressure created by air flow 340 in plenum 314 pushes against the lower surface of baffle 320 to flex baffle 320 upwards until the end of baffle 320 touches the inner wall of housing 306 at location 350, thereby closing off what was previously plenum 312 in FIG. 3. By closing off plenum 312 in response to fan 302 being non-operational, the shape of plenum 314 is optimized for maximum air flow 210 directed toward heat exchanger 200, and any backflow that may have been directed toward non-operational fan 302 is prevented. In the absence of a backflow, non-operational fan 302 remains at rest, which is sensed by a tachometer 370 that is in signal communication with control and maintenance equipment (not shown) for appropriate corrective action. The air flow exiting device 300 at exit 318 is denoted as air flow 210, which is directed toward heat exchanger 200. Accordingly, device 300 provides an air flow to heat exchanger 200 even in the presence of a non-operational fan 302.

In FIG. 5, the air pressure created by air flow 330 in plenum 312 pushes against the upper surface of baffle 320 to flex baffle 320 downwards until the end of baffle 320 touches the inner wall of housing 306 at location 360, thereby closing off what was previously plenum 314 in FIG. 3. By closing off plenum 314 in response to fan 304 being non-operational, the shape of plenum 312 is optimized for maximum air flow 210 directed toward heat exchanger 200, and any backflow that may have been directed toward non-operational fan 304 is prevented. In the absence of a backflow, non-operational fan 304 remains at rest, which is sensed by a tachometer 380 that is in signal communication with control and maintenance equipment (not shown) for appropriate corrective action. The air flow exiting device 300 at exit 318 is denoted as air flow 210, which is directed toward heat exchanger 200. Accordingly, device 300 provides an air flow to heat exchanger 200 even in the presence of a non-operational fan 304.

A result of using device 300 with redundant fans 302, 304 and flexible baffle 320, is the benefit of having an optimally shaped plenum for air flow to heat exchanger 200 regardless of whether both or only one fan is operational, and the benefit of having substantially reduced backflow to a non-operational fan such that tachometers 370, 380 can properly register the affected fan as being non-operational.

Figure 6:
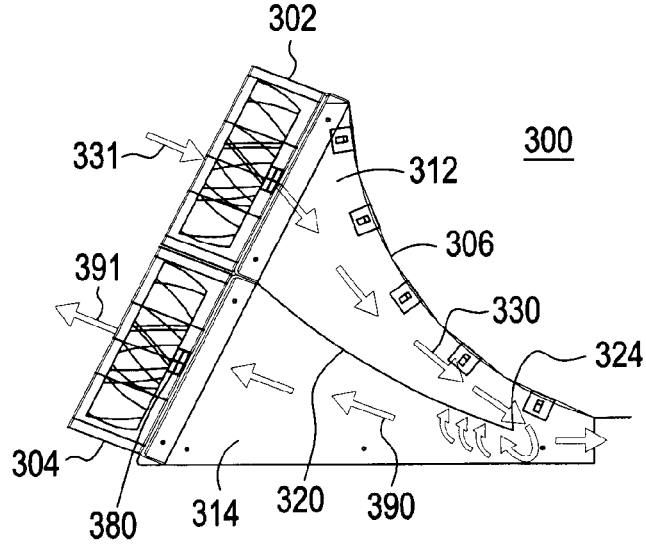
FIG. 6 depicts a similar view to those of FIGS. 3–5 but with a modification to further exemplify embodiments of the invention.

If baffle 320 was rigidly fixed to housing 306 along all edges, and only one fan 302 was operational, as depicted in FIG. 6 with reference now being made thereto, air flow 330 in plenum 312 would result from air flow 331 being drawn in by fan 302, and a backflow 390 would result from the backpressure being developed between the plenum opening at second edge 324 of baffle 320 and the non-operational fan 304. As a result, expelled air flow through non-operational fan 304, depicted by arrow 391, would produce a reverse rotation of fan 304. With such a reverse rotation, tachometer 380 would incorrectly register a functional fan 304. While not specifically illustrated, it will be appreciated that a similar situation to that just described would result if fan 304 was operational, fan 302 was non-operational, and baffle 320 was rigidly fixed to housing 306 along all edges.

In an embodiment absent the teachings disclosed herein, applicants have observed that a non-functional fan having a reverse rotation equal to or greater than about 19 Hertz did not drop the tachometer output signal sufficiently to register a non-functional fan. Conversely, applicants have observed that in an embodiment employing the teachings of a flexible baffle 320 disclosed herein, the non-functional fan stopped spinning entirely, thereby resulting in the tachometer properly registering the non-functional fan.

In view of the foregoing, some embodiments of the invention may include some of the following advantages: proper detection of a non-functional fan; proper air flow at an exit opening regardless of whether both fans are operational or only one fan; substantially reduced or negated backflow through a non-functional fan thereby reducing impediment to the air flow entering the functional fan; and, reduced fan size by using passive air flow control absent louvers that only open under the pressure of a working fan.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A device for controlling a fluid flow, the device comprising:

at least two fluid flow drivers;

a plenum disposed to receive a fluid flaw from the at least two drivers, the plenum having a first cross-sectional area proximate the at least two drivers and a second cross-section area at a distance from the at least two drivers, the second cross-sectional area being an exit for the fluid flow; and a baffle disposed within the plenum and having a first edge restrained proximate the first cross-sectional area and a second opposing edge freely disposed proximate the second cross-sectional area;

wherein the baffle has a surface area responsive to the fluid flow within the plenum to reduce a backflow if one of the at least two drivers is operational and another is non-operational; and wherein the baffle flexes in response to an air flow from each of the at least two drivers and in response to a pressure differential across the baffle such that the plenum shape changes to optimize the flow regardless of whether one of the at least two drivers is non-operational.

2. The device of claim 1, wherein the baffle further comprises unrestrained side edges disposed between the first and second edges.

3. The device of claim 1, wherein the first edge of the baffle is affixed proximate a line between two of the at least two drivers and the second opposing edge is freely disposed proximate the center of the second cross-sectional area.

4. The device of claim 3, wherein the first edge of the baffle is affixed proximate the center of the first cross-sectional area.

5. The device of claim 1, wherein in response to the baffle flexing the plenum shape is optimized.

6. The device of claim 1, wherein in response to one of the at least two drivers being operational and another being non-operational, the baffle moves to close off a part of the plenum corresponding to the non-operational driver.

7. The device of claim 1, wherein the at least two drivers comprises two fans, and the fluid flow comprises air.

8. The device of claim 7, wherein the two fans are disposed in a parallel fluid flow arrangement.

9. The device of claim 8, wherein the two fans are disposed in a same plane.

10. The device of claim 1, further comprising a tachometer for and in signal communication with each of the at least two drivers;

wherein if one of the at least two drivers is operational and another is non-operational the baffle substantially reduces the backflow toward the non-operational driver such that the associated tachometer registers a non-operational driver.

11. The device of claim 1, wherein the baffle is disposed in such a way as to divide the plenum in half in response to the at least two drivers and the baffle being at rest.

12. A heat transfer apparatus, comprising:

a heat exchanger; and a device for providing a fluid flow, the device comprising:

at least two fluid flow drivers;

a plenum disposed to receive a fluid flow from the at least two drivers, the plenum having a first cross-sectional area proximate the at least two drivers and a second cross-section area at a distance from the at least two drivers, the second cross-sectional area being an exit for the fluid flow; and a baffle disposed within the plenum and having a first edge restrained proximate the first erase-sectional area and a second opposing edge freely disposed proximate the second cross-sectional area;

wherein the baffle has a surface area responsive to the fluid flow within the plenum to reduce a backflow if one of the at least two drivers is operational and another is non-operational;

wherein the heat exchanger is disposed proximate the exit of the device and in fluid communication with the fluid flow from the device.

13. The apparatus of claim 12, wherein:

the at least two drivers comprises two fans disposed in a parallel fluid flow arrangement; and the fluid comprises air.

14. The apparatus of claim 13, wherein:

the baffle is flexible;

the baffle flexes in response to a pressure differential across the baffle such that the plenum shape is optimized regardless of whether one of the at least two drivers is non-operational; and in response to one of the at least two drivers being operational and another being non-operational, the baffle moves to close off a part of the plenum corresponding to non-operational driver.

15. The apparatus of claim 12, further comprising a tachometer for and in signal communication with each of the at least two drivers;

wherein if one of the at least two drivers is operational and another is non-operational the baffle substantially reduces the backflow toward the non-operational driver such that the associated tachometer registers a non-operational driver.

16. The apparatus of claim 12 for cooling a heat generating unit, wherein:

the second cross-sectional area is smaller than the first cross-sectional area; and the heat exchanger is in thermal communication with the heat generating unit.

17. The apparatus of claim 12, wherein:

the baffle flexes in response to a pressure differential across the baffle such that the plenum shape changes to optimize the flow regardless of whether one of the at least two drivers is non-operational.

18. A device for controlling an air flow, the device comprising:

two fans disposed in a parallel air flow arrangement;

a plenum disposed to receive an air flow from the two fans, the plenum having a first cross-sectional area proximate the two fans and a second cross-section area at a distance from the two fans, the second cross-sectional area being an exit for the air flow; and a baffle disposed within the plenum and flexibly responsive to an air flow from each of the two fans, the baffle having a first edge restrained proximate the first cross-sectional area and a second opposing edge freely disposed proximate the second cross-sectional area;

wherein the baffle flexes in response to a pressure differential across the baffle to reduce a backflow within the plenum if one of the two fans is operational and another is non-operational.

19. The device of claim 18, further comprising a tachometer for and in signal communication with each of the two fans;

wherein if one of the two fans is operational and another is non-operational the baffle substantially reduces the backflow toward the non-operational fan such that the associated tachometer registers a non-operational fan.

* * * * *

UNITED STATES PATENT AND TRADEMARK OFFICE

CERTIFICATE OF CORRECTION

PATENT NO. : 7,018,169 B2
APPLICATION NO. : 10/708286
DATED : March 28, 2006
INVENTOR(S) : Andrew G. Phillip et al.

It is certified that error appears in the above-identified patent and that said Letters Patent is hereby corrected as shown below:

Column 5,
Line 41, after "fluid", delete "flaw" and insert therefor --flow--.

Column 6,
Line 38, after "first", delete "erase" and insert therefor --cross--.
Line 62, after "to" insert --the--.

Signed and Sealed this

Nineteenth Day of December, 2006

JON W. DUDAS
*Director of the United States Patent and Trademark Office*